United States Patent [19]

Kossuth

[11] Patent Number: 4,741,929

[45] Date of Patent: May 3, 1988

[54] ROLL-COATING METHOD AND APPARATUS

[75] Inventor: Donald A. Kossuth, Buffalo, N.Y.

[73] Assignee: National Gypsum Company, Dallas, Tex.

[21] Appl. No.: 27,699

[22] Filed: Mar. 19, 1987

[51] Int. Cl.[4] ..... B05D 5/02; B05C 1/02

[52] U.S. Cl. ..... 427/258; 118/221; 118/222; 118/223; 118/262; 427/284

[58] Field of Search ..... 427/258, 284, 285; 118/221, 262, 222, 223, 224

[56] References Cited

U.S. PATENT DOCUMENTS 1,568,605 1/1926 Hough ..... 118/224 X 4,384,544 5/1983 Weishew ..... 118/224

*Primary Examiner*—Evan K. Lawrence

*Attorney, Agent, or Firm*—Laird F. Miller; Robert F. Hause

[57] ABSTRACT

A roll-coating apparatus and method of using it, the apparatus having a pair of narrow rubber tires mounted to be driven by the roll-coater doctor roll, disposed to transfer a narrow band of coating material along the two opposite edge areas of a board which is subsequently coated throughout the full width of the board by the roll-coater main applicator roll.

20 Claims, 2 Drawing Sheets

ROLL-COATING METHOD AND APPARATUS

This invention relates to predecorating wallboard and particularly to roll-coating a textured coating onto a continuously advancing uncut or precut plurality of wallboards, on a production line, and to apparatus therefor.

BACKGROUND OF THE INVENTION

Gypsum wallboard is commonly manufactured and sold with a thin layer of textured coating materials, such as a coating material containing relatively uniformly dispersed particles of sand. One method of applying such textured coating materials was by a rubber-covered roll-coater roll.

One problem that has been encountered in applying textured coating materials with a rubber-covered roll-coater roll has been in the way the edge portions along each side edge has less textured material per square inch than the balance of the wallboard face. It is believed that the pressure of the rubber applicator roll against the face of the wallboard results in the rubber protruding to a greater diameter immediately adjacent the board edges, causing the rubber just inward of each board edge to be bent upward slightly away from the board surface. This raised portion of rubber either tends to leave less textured coating material or it tends to slightly wipe off some coating material as it is flexed different from the flexing of the rubber in the other areas of the roll-coating surface. Regardless of the reason, the resultant starved edge areas are clearly noticeable and undesirable.

A simple and economical means for overcoming this problem of starved edges will be understood to be highly desirable.

SUMMARY OF THE INVENTION

The apparatus of the present invention consists essentially of a narrow rubber tire mounted relative to a roll-coater apparatus doctor roll such that the tire substantially contacts the doctor roll and the wallboard edge area and is rotated thereby to receive texture coating material from the doctor roll and transfer a substantial amount uniformly onto the edge area just prior to the wallboard, including the edge portion thereof, being passed under the roll-center rubber-covered roll.

The texture coating material transferred to the rubber tire is material that remained on the doctor roll following a step of metering texture coating material onto the rubber-covered roll-coater roll. Thus, sections of wallboard which have just had a narrow strip of texture coating material applied along each edge will immediately advance and pass under the full width rubber-covered roll-coater roll with a full layer of a texture coating material, much of which is then deposited on the entire face of that section of wallboard, including the precoated edge areas.

It is an object of the present invention to provide a simplified apparatus for supplementing the amount of a texture coating material to be applied to the edge areas of a wallboard by a rubber-covered roll-coater roll.

It is a further object to provide an improved method for applying a texture coating to wallboard, to produce a more uniform texture coating thereon.

These and other objects and advantages of the invention will be more readily apparent when considered in relation to the preferred embodiments of the invention as set forth in the following specification and shown in the accompanying drawings.

DESCRIPTION OF THE PREFERRED EMBODIMENTS

Figure 1:
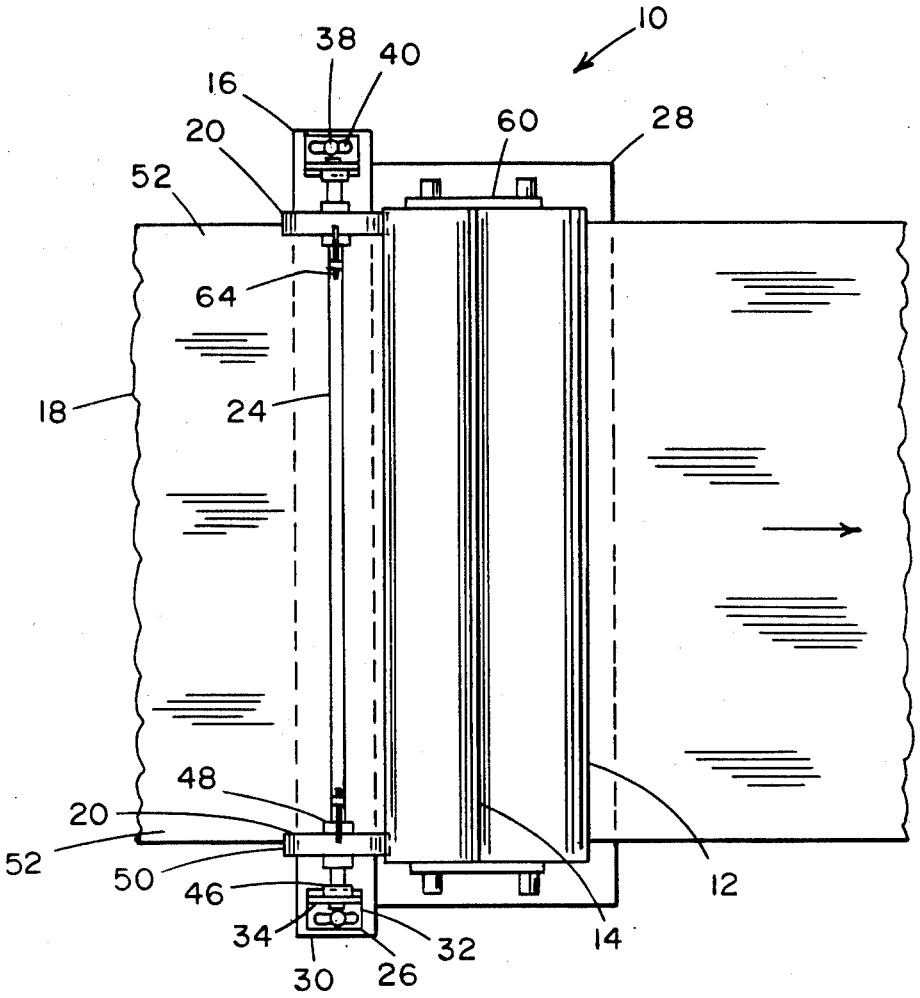
FIG. 1 is a top plan view of the roller-coater apparatus of the present invention, mounted over continuously advancing sheets of gypsum wallboard.

Referring to FIG. 1, there is shown a roll-coater apparatus 10 consisting essentially of a main wide rubber-covered applicator roll 12, a very closely spaced apart parallel chrome plated doctor roll 14, a novel edge coating assembly 16, and suitable drive means and guards, all mounted in a suitable frame.

Immediately under the roll-coater apparatus 10 there is a continuously advancing web of gypsum wallboard 18, moving from left to right.

The edge coating assembly includes two circular, narrow rubber tires 20,20, one mounted to ride on each of the two side edges of wallboard 18. The two tires 20,20 are mounted on wheels 22,22 which are rotatably mounted on a stationary axle 24.

Figure 2:
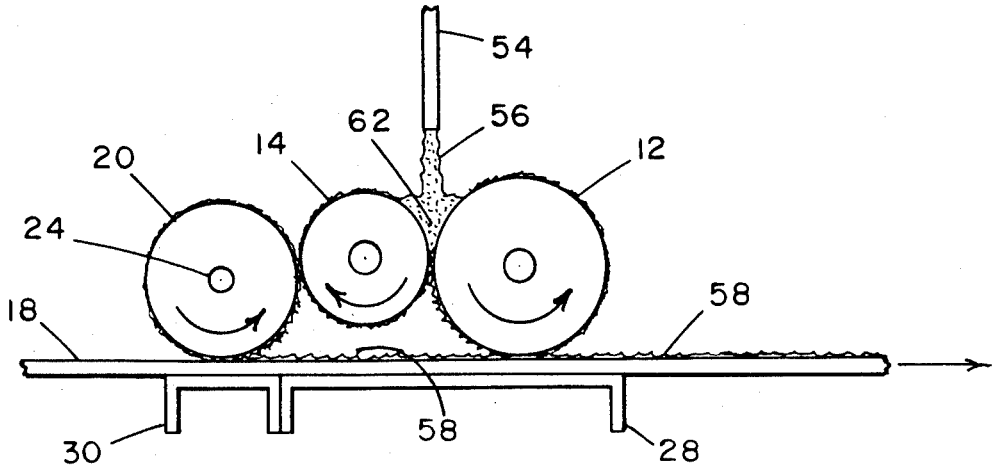
FIG. 2 is a diagrammatic side view of the principal elements of the apparatus of FIG. 1.
Figure 3:
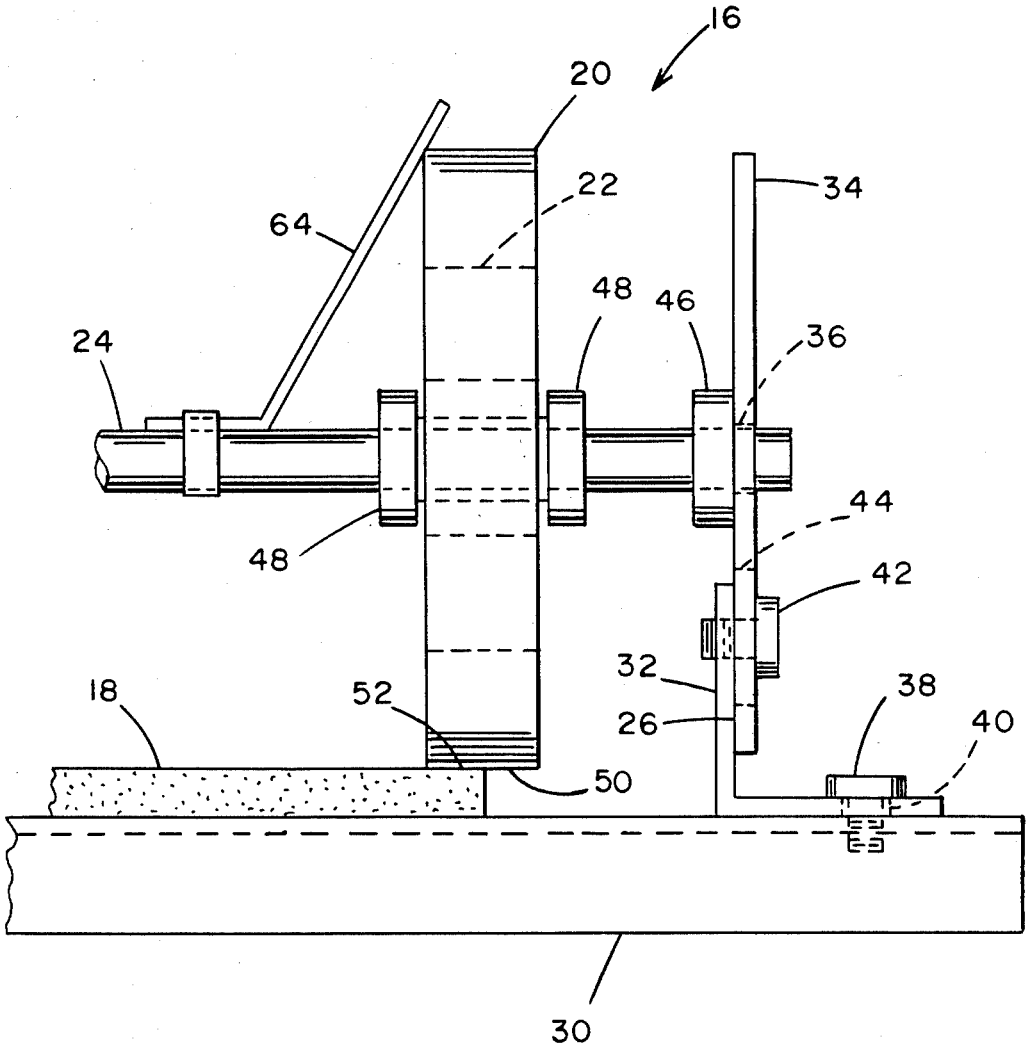
FIG. 3 is a detailed end view of one side of the edge coating elements of the apparatus of FIG. 1.

As seen in FIGS. 1–3, the axle 24 is mounted in a pair of frames 26,26, the right frame 26 being shown in detail in FIG. 3.

The wallboard 18 moves along the top surface of a roll-coater base plate 28 and a novel edge coater base plate 30 mounted against the roll-coater base plate and located immediately under the tires 20,20. The base plate 30 firmly supports the wallboard 18 as it passes under the two rubber tires 20,20.

The frames 26,26 each include a bottom angle iron 32 bolted to the edge coater base plate 30, and a vertically extending support plate 34. Support plate 34 has a hole 36 within which an end of the axle 24 is mounted.

Each angle iron 32 is bolted to the edge coater base plate 30 by a bolt 38 which extends through a longitudinal slot 40 in the angle iron 32, permitting adjustment of the location of the angle iron, to shift the tires 20,20 toward or away from the doctor roll 14.

Each support plate 34 is bolted to an angle iron 32 by a bolt 42 which extends through a longitudinal slot 44 in the support plate 34, permitting vertical adjustment of the location of the support plate 34, to shift the tires 20,20 toward or away from the wallboard 18, passing thereunder.

An outer collar 46 is affixed to the axle 24 immediately inside of the support plate 34, maintaining the disposition of the axle relative to the two support plates 34,34.

A pair of wheel collars 48,48 are adjustably affixed to axle 24 on each side of each wheel 22, maintaining the disposition of the wheel 22 and the tire 20 relative to the wallboard 18, passing thereunder. Each tire 20 has a flat outer periphery surface 50, as shown in FIG. 3, which is between about one and two inches wide, with about one-half the width thereof riding on the edge area 52 of the wallboard 18.

As shown best in FIG. 2, a supply hose 54 continuously supplies a slurry 56 of sand-containing texture coating 58, which slurry 56 is contained, by end walls 60, in a channel 62 formed by the closely-spaced doctor roll 14 and applicator roll 12.

The doctor roll 14 and the applicator roll 12 are each rotating continuously with their adjacent sides moving downwardly, carrying with them a controlled amount of texture coating 58. As is well known, in the roll-coating art, the amount of texture coating 58 which will be carried with the doctor roll 14 and the applicator roll 12 can be controlled by adjustment of the spacing between the two rolls by conventional means, not shown.

As shown in FIG. 2, the rubber-covered applicator roll 12 rotates counterclockwise, with the bottom surface moving to the right at approximately the same speed as the movement of the wallboard 18 to the right, immediately thereunder. The applicator roll 12 is positioned sufficiently close to the wallboard 18 to transfer a substantial portion of the texture coating 58, thereon, to the wallboard 18.

A portion of the texture coating material 58 which is caused to pass downward with the doctor roll 14 and the applicator roll 12 adheres to the doctor roll 14. Doctor roll 14 rotates clockwise and is positioned so that it does not contact the wallboard 18. The portion of texture coating material 58 which remains on the doctor roll 14 will mostly all simply return to the slurry 56 in channel 62.

However, in accordance with the invention, a very small portion of the texture coating material 58 on the doctor roll 14 will be removed therefrom by the two rubber tires 20,20, which are mounted in very close proximity thereto. This small amount of texture coating material 58 which is transferred to the two rubber tires 20,20 is carried by the tire peripheral surfaces 50,50 until the surfaces 50,50 of the two tires 20,20 contact the two respective edge areas 52,52 of the wallboard 18, whereat a substantial portion of texture coating material 58 is transferred onto the wallboard edge areas 52,52. As seen in FIG. 2, the thus precoated wallboard edge areas 52,52 then move rightward to be again coated by the applicator roll 12, as it applies a coating onto the entire width of the wallboard 18.

A texture coating material which can be more advantageously applied by use of the present invention can be one having about 20% by weight of white uniform rounded-grain silica sand, substantially all of which is fewer than a 20 U.S. sieve but coarser than a 40 U.S. sieve, within a latex binder such as a vinyl chloride, vinyl acetate, acrylic or styrene-butadiene latex. Such a coating will add about 0.03 inch to the thickness of the wallboard and about 88 lb/thousand square feet to the weight of the wallboard, prior to drying the coating, about ⅓ being volatiles.

The coating material is applied at a rate of about 75 to 100 feet per minute, with the roll-coater 10, including the edge coating assembly 16.

In a preferred embodiment, the applicator roll 12 has a diameter of about 9 inches and an axial length of about 52 inches and the doctor roll is of 7 inches diameter, and also 52 inches long. The tires 20,20 are of an 8-inch diameter and about 1½ inch wide at the outer periphery. A wire wiper rod assembly 64 is shown mounted to contact the inner edge of the peripheral surface 50 of tire 20 to push texture coating 58 back away from the edge of surface 50.

In the operation of the roll-coater apparatus 10, wallboard 18 is constantly fed, first under the tires 20,20 which applies a thin layer of texture coating 58 onto the two edge areas 52,52. The wallboard then passes under the applicator roll 12, which applies a thin layer of texture coating 58 onto the entire width of the face surface of wallboard 18, including the two edge areas 52,52 where a thin layer had already been deposited. The problem of the prior art tendency to deposit less texture coating 58 in the edge areas 52,52 is now overcome by the presence of the preapplied coating by the tires 20,20.

Having completed a detailed disclosure of the preferred embodiments of my invention so that those skilled in the art may practice the same, I contemplate that variations may be made without departing from the essence of the invention or the scope of the appended claims.

I claim:

1. The method of applying a coating to the face of a wide flat board comprising the steps of advancing a continuous supply of board under the applicator roll of a roll-coating apparatus, continuously depositing a thin layer of coating along the narrow edge areas of said face of said board and subsequently continuously depositing thin layer of coating throughout the entire face area of said continuously advancing board by transfer of coating material from said applicator roll.

2. The method of claim 1 wherein said narrow edge areas are coated by narrow circular tires which are rotatably mounted to remove coating material from a rotating doctor roll for said applicator roll and deposit at least a substantial portion of said removed coating on the edge areas of said board.

3. The method of claim 2 wherein said rotatably mounted tires are mounted to be driven by said rotating doctor roll and the advancing supply of board with which said tires are substantially contacted through the coating material thereon.

4. The method of claim 2 wherein said narrow tires have a rubber peripheral surface.

5. The method of claim 2 wherein a slurry of a relatively coarse texture coating is continuously supplied to a channel formed by said doctor roll and said applicator roll, said doctor roll and said applicator roll are rotated with adjacent sides moving downward and each carry therewith a controlled amount of said texture coating, and said doctor roll subsequently transfers a substantial portion of coating onto said tires, to then be transferred to said board narrow edge areas.

6. The method of claim 5 wherein said board is paper covered gypsum wallboard and said texture coating contains sand substantially all of which has a particle size which will pass through a 20 U.S. sieve and will be retained on a 40 U.S. sieve.

7. The method of claim 5 wherein said texture coating adds about 0.03 inch to the board thickness.

8. The method of claim 5 wherein said board is coated at a rate of about 75 to 100 feet per minute.

9. The method of claim 5 wherein said coating is applied at a rate of about 88 lb per thousand square feet.

10. The method of claim 6 wherein the edge coating step results in increasing the amount of coating material in the edge areas and providing a finish coating which is substantially uniform throughout the wallboard face area.

11. A roll-coating apparatus consisting essentially of a frame supporting an applicator roll for applying coating over the entire area of product being coated thereunder, a closely spaced parallel doctor roll and a pair of narrow circular tires each rotatably mounted to ride on the two side edge areas of said product being coated thereunder, said tires also being mounted to substantially contact said doctor roll and to thus remove coating material from said doctor roll and transfer said coating material to said side edge areas of said product prior to said coating of said entire area of said product.

12. A roll-coating apparatus as defined in claim 11 wherein said tires have a rubber outer periphery.

13. A roll-coating apparatus as defined in claim 11 wherein said tires are rotatably mounted with no drive means other than the movement imparted by product moving thereunder and the contact that is made with the doctor roll and any coating material that may be thereon.

14. A roll-coating apparatus as defined in claim 13 wherein said tires have a rubber outer periphery.

15. A roll-coating apparatus as defined in claim 11 wherein said tires are mounted on wheels which are rotatably mounted on a stationary axle and said stationary axle is mounted on frame elements having means for adjustable positioning relative to said doctor roll and to where product to be coated passes thereunder.

16. A roll-coating apparatus as defined in claim 11 wherein said main applicator roll has a diameter of about nine inches, said doctor roll has a diameter closely similar but smaller than said main applicator roll, and said tires have a diameter approximately that of said applicator and doctor rolls.

17. A roll-coating apparatus as defined in claim 16 wherein said main applicator roll and said doctor roll have drive means for driving them in opposite rotary directions and said tires are mounted to be driven by said doctor roll in a rotating direction opposite to that of said doctor roll.

18. A roll-coating apparatus as defined in claim 17 wherein said tires have a rubber outer periphery.

19. A roll-coating apparatus as defined in claim 18 wherein said tires are mounted on wheels which are rotatably mounted on a stationary axle.

20. A roll-coating apparatus as defined in claim 19 wherein said stationary axle is mounted in a support plate which is adjustably bolted to a short section of angle iron, said angle iron being adjustably bolted to an edge coater base plate disposed below said tires for supporting board being coated by said tires.

* * * * *